US007527466B2

(12) United States Patent
Simmons

(10) Patent No.: US 7,527,466 B2
(45) Date of Patent: May 5, 2009

(54) BUILDING-ERECTION STRUCTURAL MEMBER TRANSPORTER

(76) Inventor: Robert J. Simmons, 27308 Fairview Ave., Hayward, CA (US) 94542

( * ) Notice: Subject to any disclaimer, the term of this patent is extended or adjusted under 35 U.S.C. 154(b) by 410 days.

(21) Appl. No.: 10/812,749

(22) Filed: Mar. 29, 2004

(65) Prior Publication Data

US 2004/0197165 A1 Oct. 7, 2004

Related U.S. Application Data

(60) Provisional application No. 60/460,622, filed on Apr. 3, 2003.

(51) Int. Cl.
*E04G 3/10* (2006.01)

(52) U.S. Cl. ..... 414/10; 182/150

(58) Field of Classification Search ..... 414/661, 414/462, 466, 10; 187/237; 182/3, 142; 52/126.3, 126.5

See application file for complete search history.

(56) References Cited

U.S. PATENT DOCUMENTS

| | | | | | |
|---|---|---|---|---|---|
| 2,639,051 | A * | 5/1953 | Thomas | 414/661 |
| 2,820,561 | A * | 1/1958 | Meagher | 414/607 |
| 3,072,275 | A * | 1/1963 | Ralston | 414/462 |
| 3,268,033 | A * | 8/1966 | Goodacre | 187/223 |
| 3,379,281 | A * | 4/1968 | Calletti et al. | 182/113 |
| 3,942,663 | A * | 3/1976 | Wentzel | 414/420 |
| 4,462,749 | A * | 7/1984 | Crocker et al. | 414/745.9 |
| 4,467,888 | A * | 8/1984 | Hickling | 182/19 |
| 4,705,140 | A * | 11/1987 | Dudley et al. | 182/3 |
| 4,749,060 | A * | 6/1988 | Vandelinde | 182/222 |
| 5,048,640 | A * | 9/1991 | McConville et al. | 182/36 |
| 5,634,529 | A * | 6/1997 | Nguyen et al. | 182/113 |
| 5,644,111 | A * | 7/1997 | Cerny et al. | 187/393 |
| 6,264,001 | B1 * | 7/2001 | Herschbach | 182/150 |
| 2001/0036395 | A1 * | 11/2001 | Talbott | 414/462 |

* cited by examiner

*Primary Examiner*—Charles A Fox
(74) *Attorney, Agent, or Firm*—Jon M. Dickinson, PC; Robert D. Varitz, PC

(57) ABSTRACT

A machine-liftable, open-framework, cage-like transporter for lifting and maneuvering horizontal structural beam elements, and the like, to appropriate installation elevations at and from the side of a plural-story building frame which is under construction. The transporter acts as a building-frame construction aid in the form of a worker-carrying, liftable, open-cage transporter including a volume-defining cage in which one or more worker(s) can station and ride, with this transporter possessing an overhead, fully exposed-from-below, support deck on which structural frame components, such as beam components, can be placed and supported in horizontal dispositions for lifting by the transporter to the appropriate elevation(s) in an emerging building frame which is being assembled. The open, overhead framework of the transporter promotes easy conveyance of such beam components to appropriate heights for delivery, precision aligning, locating, positioning and assembly within a building frame. It also offers special construction efficiency by allowing a worker, or workers, who are "inside" the cage of the transporter to reach upwardly from within the cage, through the open, overhead framework of the support deck, thus to contribute and assist in the off-loading and precision handling of transported components.

1 Claim, 3 Drawing Sheets

BUILDING-ERECTION STRUCTURAL MEMBER TRANSPORTER

CROSS REFERENCE TO RELATED APPLICATION

This case claims priority to U.S. Provisional Patent Application Serial No. 60/460,622, filed Apr. 3, 2003 by the same inventor who is named in the present Regular Patent Application, for "Building-Erection Structural Member Transporter". The entirety of that provisional case is hereby incorporated herein by reference.

BACKGROUND AND SUMMARY OF THE INVENTION

This invention pertains to a construction-aid, load-handling transporter and manipulator structure for handling elongate building-frame beam components during the construction of a plural-story building frame. In particular, it relates to such a transporter which has an open-frame cage-like construction that is designed for machine lifting and maneuvering of different kinds of beam components up and along the outer side of a plural-story steel column and beam frame structure which is being assembled for a building. The transporter of the invention, which has a platform-bottomed volume of space for one or more workers beneath where a beam component is held, functions handily to carry one, or several, yet unattached beam components efficiently for precision alignment and positioning for installation at different building-frame elevations (sites) where such components are to be affixed in place.

For the purpose solely of illustration herein, a preferred embodiment of the transporter of the invention is described as one particularly designed for lifting and maneuvering by a machine which operates a pair of lift forks. Many other kinds of lifting and maneuvering machines may be used, of course, and so the specific structural arrangement used for disclosure herein relating to left forks provides but one good illustration of the versatility of the invention.

Beam components to be transported by the invention, and in accordance with use of the invention, lie on a generally planar and horizontal "overhead" support deck, or deck structure, which is formed as an open framework through which a worker below has clear vertical access to provide whatever delivery and installation assistance may be desired or needed. This deck structure features a swingably-mounted lateral extension which can be deployed laterally outwardly relative to the building-frame-facing side of the transporter to assist, especially, in the handling of generally T-shaped (as distinguished from uni-linear) beam components. A T-shaped beam component, as discussed and illustrated herein, is an assembly of two uni-linear beam components which intersect to form a T. A uni-linear beam component is simply a straight linear component, such as a straight I-beam. Opposite this building-frame-facing side, the transporter includes a fork-receiving side for receiving (removeably) appropriate lift forks.

One or plural worker(s) can "ride" with a transported load disposed overhead, thus to be stationed in relative positional "readiness" for aiding in the off-loading, positioning, precision aligning, etc. of a beam component near an installation site in a structural building frame.

As will be seen, the transporter of this invention is quite simple and elegant in construction, and lends itself for useful application in many kinds of building projects. And, it should be understood that, while a preferred and best mode embodiment of the invention is described and particularly illustrated herein in relation to handling traditional "beam components", the transporter of the invention could function just as well for handling other types of similar, bulky components.

As suggested above, the particular transporter embodiment (preferred and best mode) which is illustrated and described herein, is discussed in the specific contexts of handling both uni-linear (straight) and T-shaped beam components. The drawings which are employed to illustrate the invention are not drawn herein to scale, as is true also for the two different kinds of beam components which are particularly pictured and described.

The various features and advantages that are offered by the invention will now become more fully understood and apparent as the detailed description which now follows is read in conjunction with the accompanying drawings.

DETAILED DESCRIPTION OF THE INVENTION

Figure 1:
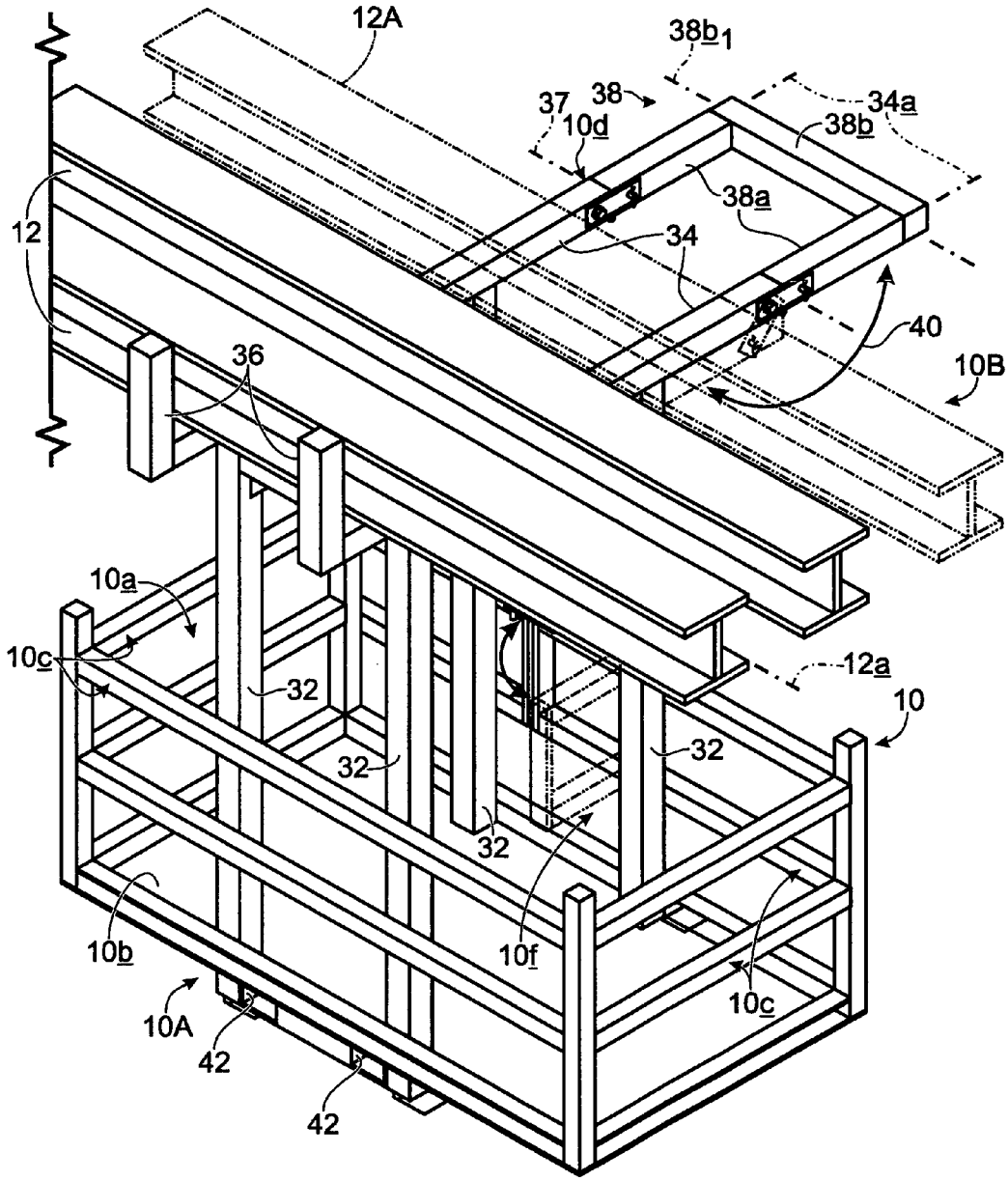
FIG. 1 is an isometric view looking generally down at, and slightly from one side of, a preferred and best-mode embodiment of the transporter invention. Two uni-linear, elongate, structural I-beams are shown resting on a load-support deck structure, or deck, in the transporter, with one of these beams also being shown in dash-double-dot lines in a moved position (as if during off-loading). As stated earlier, the transporter embodiment chosen for illustration of the invention herein is designed to be handled by lift forks.

Turning now to all of the drawing figures, indicated generally at 10 is a cage-like load-transporter which is constructed in accordance with a preferred and best-mode embodiment of the present invention. Transporter 10, which is also referred to herein as being a machine liftable and maneuverable device, is designed for handling, and for promoting the installation-site delivery, and precision placement and alignment, of elongate building-frame beam components, such as uni-linear I-beam components 12, and T-shaped components (like the one shown at 14 in FIG. 3), during construction of a plural-story building frame, such as the one shown generally and fragmentarily at 16 in FIG. 2. What is referred to herein later as an installation site in frame 16 is shown generally at 16A in FIG. 2. Representative T-shaped beam component 14 is formed as an assembly of right-angularly intersecting cap and stem sub-components 14*a*, 14*b* respectively. Beam components 12 include long axes, such as that shown at 12*a* in FIG. 1 for one of these components, and a beam component 14 includes cap and stem long axes $14a_1$ and $14b_1$, respectively, as shown in FIG. 3.

Figure 2:
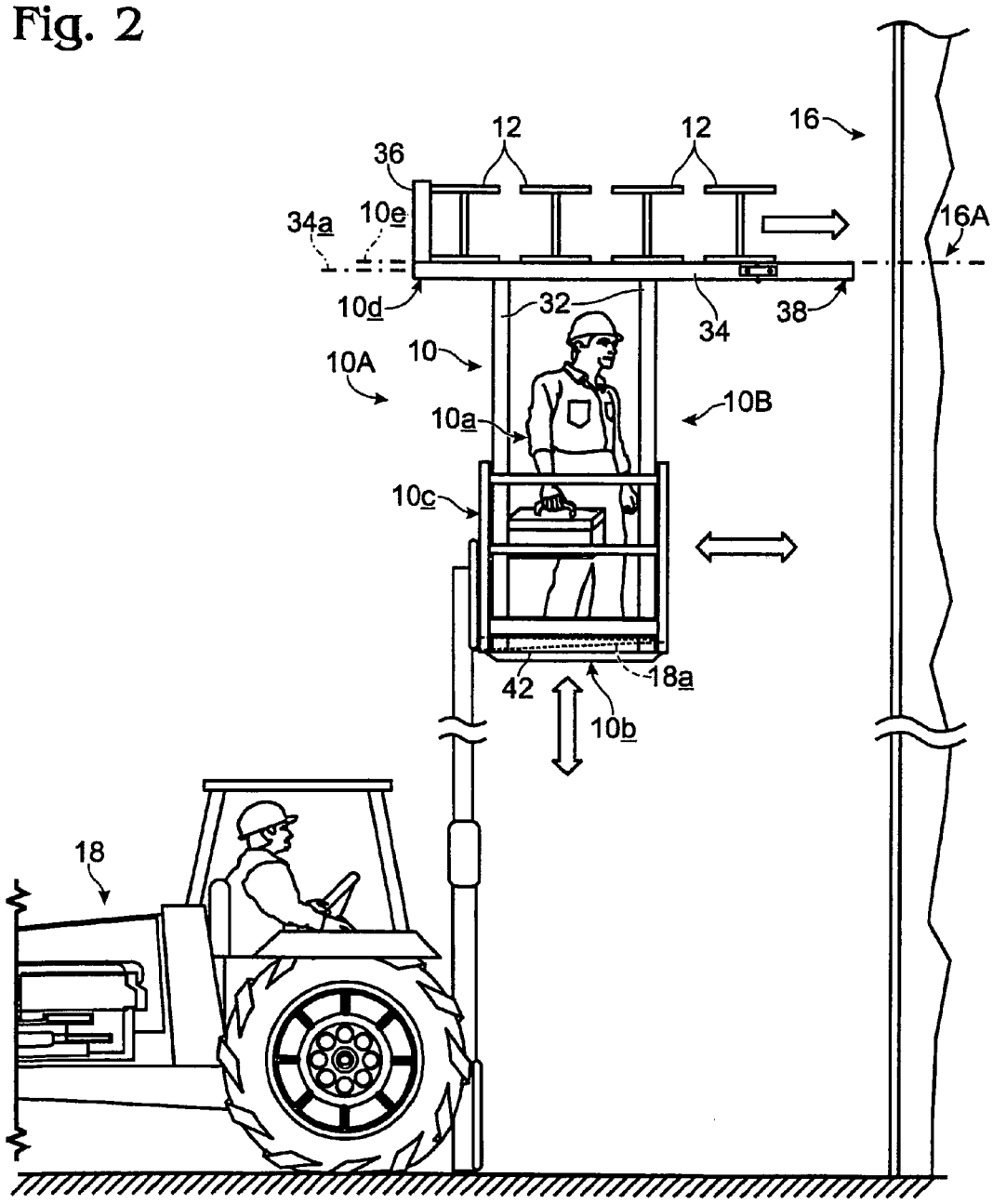
FIG. 2 is a smaller-scale side view of the transporter of FIG. 1 illustrated in a condition of use, and specifically shown being carried and lifted on and by the forks in a conventional lift truck. The illustrated lift truck is intended, or course, only to be generally representative of various kinds of load-handling lifting and maneuvering machines which can be used to hold and manipulate the transporter.

The term "crane" herein is intended to refer to any suitable piece of construction equipment, such as the fork-lift truck shown at 18 in FIG. 2, which can maneuver and lift transporter 10. Truck 18 does this through the use of lift forks, such as the single such fork shown at 18*a* in FIG. 2.

As can be clearly seen, transporter 10 has a very simple and straight-forward open-framework, cage-like construction. This construction includes (a) a space referred to herein as a worker occupancy volume, or space, 10*a* which is horizontally "floored" by panel-like floor structure 10*b*, (b) floor-perimeter wall structure 10*c* which effectively defines the entire perimeter of space 10*a* (though it could be made partial-only, if desired), and (c) an overhead load-support deck structure 10*d* which defines a generally horizontal support plane 10*e* (see especially FIGS. 2 and 4) for supporting handled beam components, such as previously mentioned beam components 12, 14. The term "floor perimeter" employed herein is defined to have an adjectival meaning which refers to a structural disposition relative to the perimeter of a floor.

Figure 3:
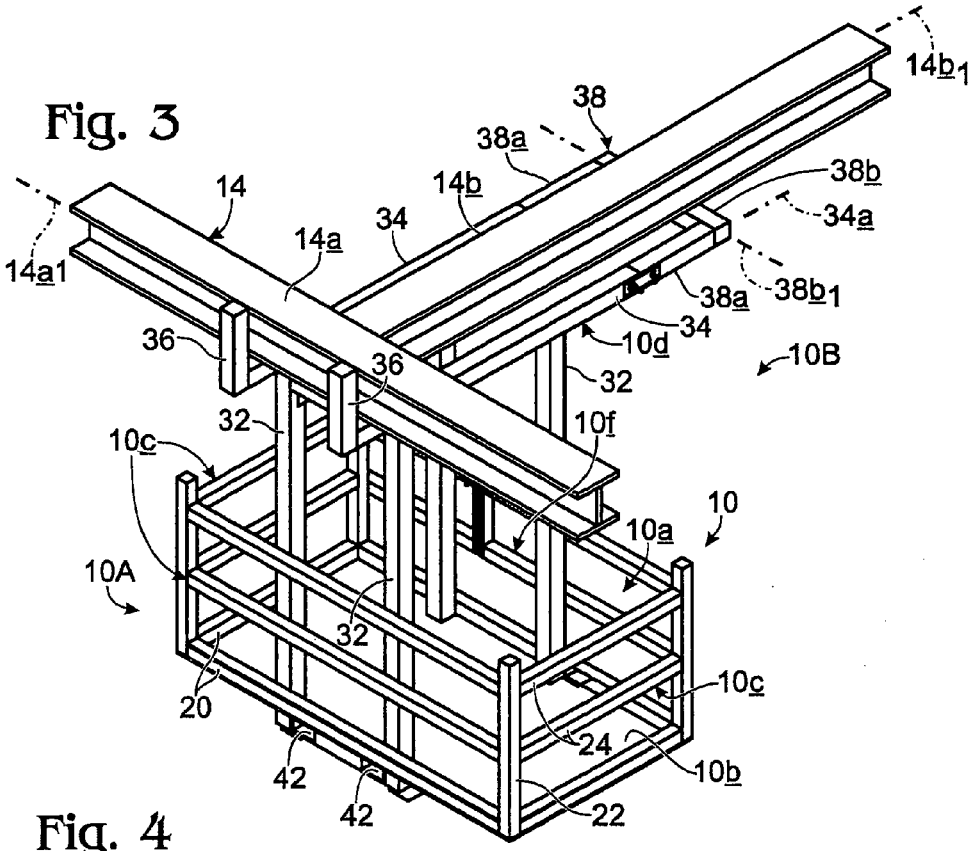
FIG. 3 presents generally a smaller-scale version of FIG. 1, but here showing the transporter of the invention supporting and handling a single T-shaped structural beam component (assembly).
Figure 5:
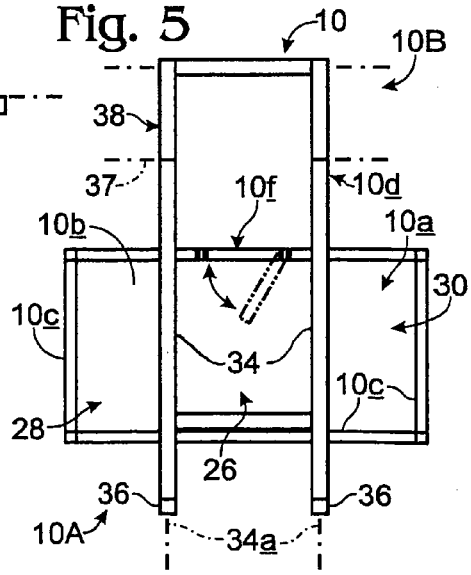

While it is not essential that a transporter built in accordance with this invention have a configuration matching that shown in the drawing figures, the basic elements of the transporter should include (1) a worker occupancy volume suitable for use by, perhaps, one to three workers (one is shown in FIG. 2), (2) a floor structure for standing on in that volume, (3) appropriate protective wall structure which preferably includes a side-access-providing swing gate, such as that shown at 10*f* in FIGS. 1, 3 and 5, and (3) an overhead load-support deck structure configured appropriately for supporting beam components on a generally horizontal plane, such as on previously mentioned plane 10*e*.

Various conventional materials and joinery approaches may be employed to construct the transporter. In the transporter specifically shown herein, hollow, square-cross-section, steel, beam-like and column-like elements are joined generally to form the open-framework and cage-like configuration of the transporter. The floor structure, which may typically be an open grate of material, such as expanded steel sheet metal, is perimetered by four horizontal beam-like elements, such as those shown at 20. The wall structure may be formed by corner uprights, such as upright 22, joined by horizontal spanners, such as spanner 24. Previously mentioned gate 10*f* is preferably formed of similar and appropriately dimensioned uprights and spanners, and is suitably mounted for swinging about an upright axis between open and closed conditions. An appropriate conventional releasable latching structure (not shown) is provided for retaining the gate in a closed condition.

The wall structure preferably aids in defining an elongate worker zone (the worker occupancy volume) having a central region 26, and two lateral side regions 28, 30 (see especially FIG. 5).

Corner-bracketing central region 26 are four relatively tall (perhaps about 7-8-feet) uprights, such as those shown at 32. It is to the tops of these four uprights that deck 10*d* is attached—this deck herein being formed, at least partially, as an open-framework pair of laterally spaced, generally parallel and horizontal beam-like elements 34 whose long axes are shown at 34*a*. Rigidly attached to one set of ends of elements 34 are two, short, obvious-function "load-stop" risers, or riser structure, 36. Pivotally attached at the other set of ends of elements 34, for limited swinging in a vertical plane about a generally horizontal axis 37, is a somewhat U-shaped structure 38 which is considered herein to be a part of support deck 10*d*, and which functions in this deck as a laterally deployable lateral extension. Extension 38 is formed as an open-framework structure, and includes two beam-like elements 38*a* which are united through an elongate, beam-like cross-piece 38*b* whose long axis is shown at $\mathbf{38}b_1$. Axis $\mathbf{38}b_1$, is disposed substantially normal to axes 34*a*.

Figure 4:
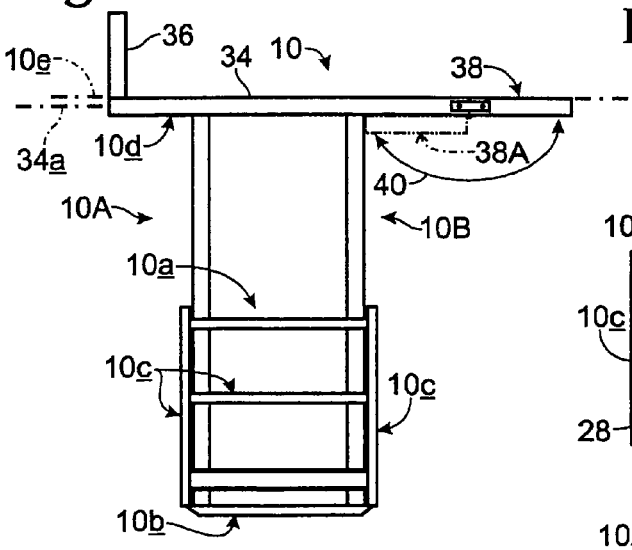
FIGS. 4 and 5, which have been drawn on a slightly smaller scale than that used in FIG. 3, show isolated side elevation and top plan views, respectively, of the transporter of FIGS. 1-3, inclusive.

In solid lines in all of the drawing figures, extension 38 is shown laterally outwardly extended. In this condition, its upper "surface" is substantially co-extensive with plane 10*e*. In dash-double-dot lines in FIG. 4, the extension is shown at 38A in a withdrawn and stowed condition below deck elements 34. A curved, double-headed arrow 40 in FIGS. 1 and 4 illustrates deployability/stowability of extension 38. Any suitable form of releaseable latching mechanism may be used to retain extension 38 selectively in either of its two principal "operating" conditions/positions (stowed/deployed).

Completing a description of transporter 10, this transporter includes what is referred to herein as a building-frame-facing side 10B, and a fork-receiving, or opposite, side 10A. One should understand that the reference herein to a fork-receiving side is made simply to be consistent with the particular form of transporter 10 which has been chosen for illustration of the invention in this disclosure. Fork reception tubes 42 (see particularly FIGS. 1-3, inclusive) reside on the underside of floor structure 10*b* to receive, from side 10A of the transporter, inserted lift forks, such as previously mentioned fork 18*a*. Previously mentioned load-stop risers 36 are located adjacent side 10A of the transporter, and deployable extension 38 is located adjacent side 10B. Elements 34 in support deck 10*d* generally extend between transporter sides 10A, 10B.

In a typical building-frame construction operation employing this invention, beginning at ground level beam elements are readied for installation by placing them appropriately on the upper load-support deck of the transporter's open, cage-like framework. Interestingly to note, in relation to the ways in which transporter 10 handles the two specific types of beam components illustrated and described herein, are the following:

(a) uni-linear beam components, such as components 12, are preferably handled with their singular long axes disposed across and substantially normal to the long axes 34*a* of deck elements 34 (see FIG. 1). In such a condition, they are very well supported;

(b) T-shaped beam components, such as beam component 14, are preferably each handled with its cap sub-component 14*a* long axis $\mathbf{14}a_1$ disposed across and substantially normal to the long axes 34*a* of deck elements 34, and with its stem sub-component 14*b* long axis $\mathbf{14}b_1$ disposed across and substantially normal to the long axis $\mathbf{38}b_1$ of extension cross-piece 38*b*. This is a very stable handling position for such a beam component.

One or more workers take(s) a station inside the worker occupancy volume, and ride upwardly with the transporter along the outer side of a building frame, such as frame 16, which is being assembled. Lifting is accomplished by the appropriately selected lifting and maneuvering machine, and in the arrangement now being described, this, of course, is lift truck 18. In this setting, forks are inserted for action into fork-receiving tubes 42 that are provided on the underside of the transporter.

The open upper surface, or deck, of the transporter, where such beam elements are placed, provides a generally horizontal, open skid surface for shifting, aligning and precision placing during off-loading of these elements when they have been raised to the proper elevation, such as to previously mentioned installation site 16A in frame 16. Because of the openness of the framework of the transporter, workers inside the transporter cage can easily provide any necessary off-loading, aligning and positioning assistance by working upwardly through (vertical pass-through) that open framework which defines the load-support deck.

Not shown or discussed herein are several conventionally desirable structures. For example, prudent construction practice suggests providing the transporter with suitable safety devices, such as anchoring points for a worker safety harness, as well as anchoring points for overhead load securement. Appropriate structure may also be provided in, or adjacent, the worker occupancy volume to hold necessary worker tools. None of these structures forms any part of the present invention.

The specific shape/configuration of the transporter can of course be modified as desired to suit different applications. Lifting and maneuvering structural accommodation can easily be designed as desired into any otherwise selected transporter configuration, as is illustrated specifically herein by the provision of fork-receiving tubes 42 on the underside of the transporter.

Thus, while a preferred and best-mode embodiment of the invention has been illustrated and described herein, it is recognized that variations and modifications may be made without departing from the spirit of the invention.

I claim:

1. A machine-liftable and maneuverable, open cage load transporter for handling and promoting installation-site delivery, during the construction of a plural story structural building frame, of both linear and T-shaped building-frame beam components, where such T-shaped components include elongate, angularly intersecting and interconnected cap and stem sub-components, said transporter comprising:

a fork-receiving side and an opposite building-frame-facing side, load-lateral-delivery side, a worker occupancy space fully occupying the inside of a worker-carrying cage structure, defined by substantially horizontal floor structure extending over the entire horizontal expanse of the cage structure, which is joined to substantially upwardly extending, open, and at least partially floor-perimeter wall structure, and disposed substantially directly overhead said floor and wall structures, and above said worker occupancy volume, generally upwardly facing, open, planar, horizontal, elongate, load-support deck structure having (a) one end adjacent the mentioned load-lateral-delivery side, (b) an opposite end defined by upwardly extending load-stop riser structure, and (c) including a pair of elongate, laterally spaced beam elements whose long axes extend generally between said sides, said deck-structure being adapted for the overhead supporting and load-carrying of all elongate building-frame beam components which are to be handled by the transporter, and having a framework which is open to the underlying worker occupancy volume so as to accommodate load-handling personnel access, and to promote attended personnel assistance, by a worker stationed in said occupancy volume, said deck structure further including, adjacent its said one end, a deployable lateral extension having an elongate beam cross-piece, which extension can be extended and withdrawn selectively and laterally outwardly from and inwardly toward said transporter's said load-lateral-delivery side to form, when extended outwardly, a substantially co-planar lateral extension of said load-support deck structure, thus to accommodate the delivery, toward a building frame installation site, of a transported and handled building-frame beam component, said beam elements in said deck structure being disposed to support both (a) a linear beam component, and (b) the cap sub-component in a T-shaped beam component in a condition with that cap sub-component's long axis extending generally transversely of the long axes of said beam elements and closely adjacent said load-stop riser structure, and said lateral extension, with the extension deployed and extending outwardly adjacent the transporter's said load-lateral-delivery side, being disposed to support the stem sub-component in such a T-shaped beam component with the long axis of that stem sub-component extending generally transversely relative to the long axis of said beam cross-piece.

* * * * *